United States Patent [19]

Reuschel

[11] Patent Number: 4,685,600

[45] Date of Patent: Aug. 11, 1987

[54] CARTRIDGE CARRIER AND DISPENSER

[76] Inventor: Donald L. Reuschel, 3724 38th St., Hamilton, Mich. 49419

[21] Appl. No.: 874,594

[22] Filed: Jun. 16, 1986

Related U.S. Application Data

[63] Continuation of Ser. No. 660,410, Oct. 12, 1984, abandoned.

[51] Int. Cl.[4] ..... F42B 39/02

[52] U.S. Cl. ..... 224/203; 224/196

[58] Field of Search ..... 224/918, 919, 196, 203, 224/251, 257, 239; 206/3; 221/185, 310, 193, 194

[56] References Cited

U.S. PATENT DOCUMENTS

| | | | |
|---|---|---|---|
| 45,469 | 12/1864 | Blakeslee | 224/203 |
| 162,481 | 4/1875 | Lee | 224/203 X |
| 1,023,489 | 4/1912 | Altick | 221/185 |
| 1,551,061 | 8/1925 | Silcott | 221/185 |
| 1,739,780 | 12/1929 | Buhrke | 224/918 X |
| 2,122,003 | 6/1938 | Cooper | 221/185 |
| 2,528,648 | 11/1950 | Garver | 224/224 X |
| 2,768,775 | 10/1956 | Houser | 224/919 X |
| 3,219,244 | 11/1965 | Blask | 221/310 |
| 3,281,013 | 10/1966 | Motard | 224/919 X |
| 3,497,118 | 2/1970 | Najjar | 224/918 X |
| 3,845,889 | 11/1974 | Hurd | 221/185 |
| 4,042,156 | 8/1977 | Knight | 224/919 X |
| 4,088,251 | 5/1978 | Rodriguez | 224/919 X |
| 4,381,845 | 5/1983 | Feis | 224/196 X |
| 4,583,659 | 4/1986 | Carter | 224/239 X |

*Primary Examiner*—Stephen Marcus
*Assistant Examiner*—Robert M. Petrik
*Attorney, Agent, or Firm*—Reising, Ethington, Barnard, Perry & Milton

[57] ABSTRACT

A cartridge carrier and dispenser with a shoulder sling support is disclosed. It comprises a curved rigid tube witha unitary dispenser and is adapted to receive plural cartridges in end-to-end relation. A cartridge dispenser slot is provided in the wall of the tube adjacent a stop pin at the bottom of the tube. A finger opening with a deflectable tongue is provided opposite the dispenser slot so that the user can apply finger pressure to displace the lower end of the cartridge through the dispenser slot. The dispenser slot is bounded by gripping edges and a tab to retain the cartridge in an oblique position with the lower end extending out of the tube and the upper end within the tube. The cartridge is held in the oblique position until the user grasps the lower end and pulls it through the dispenser slot.

11 Claims, 6 Drawing Figures

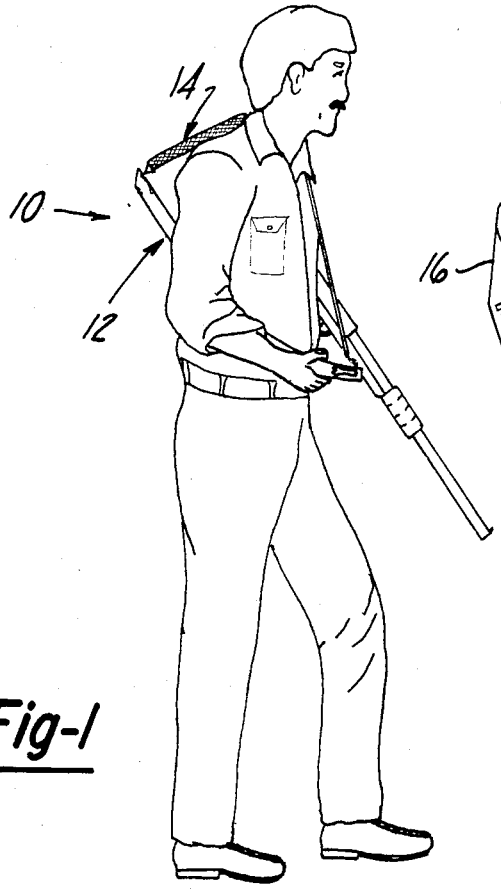
Fig-1
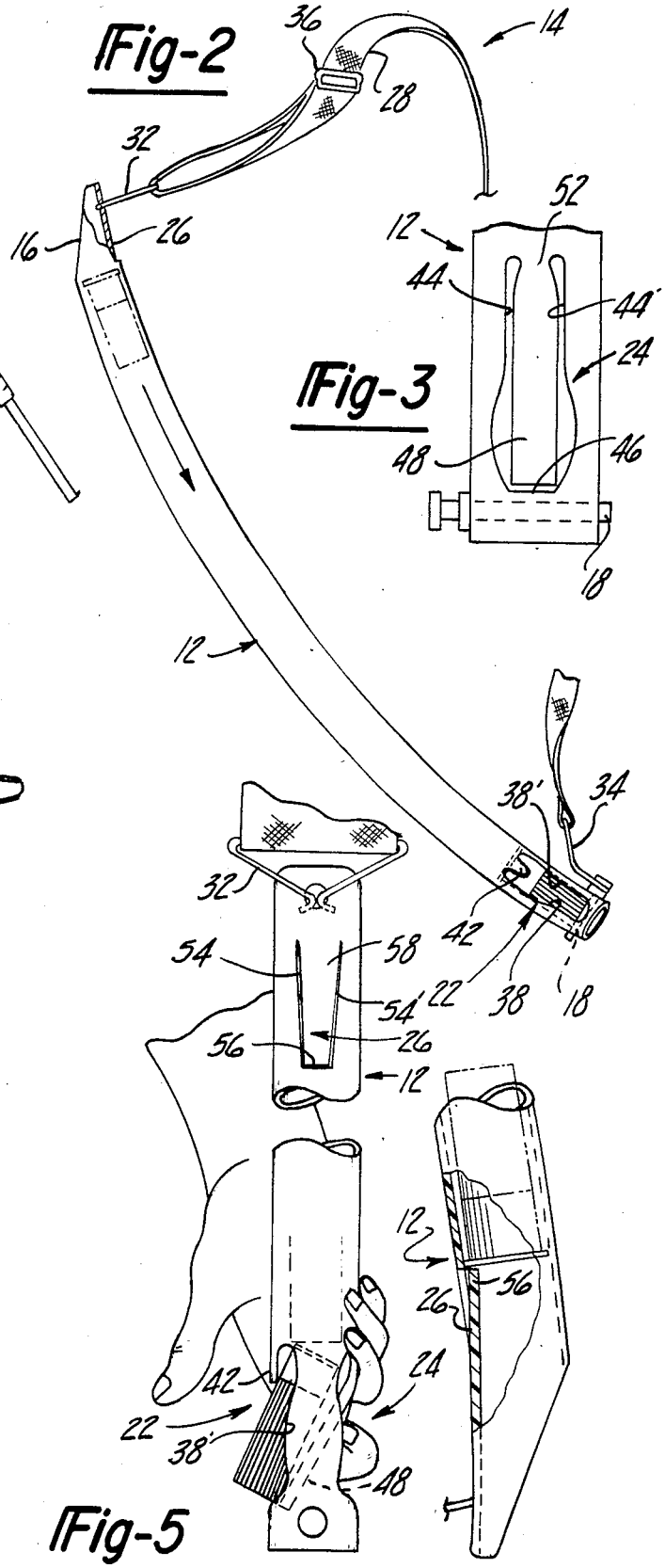
Fig-2
Fig-3
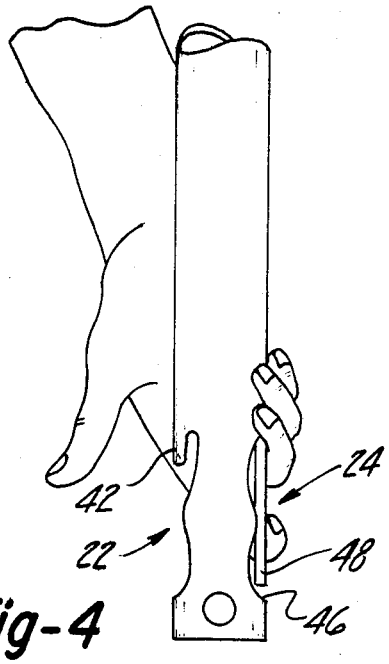
Fig-4
Fig-5
Fig-6

CARTRIDGE CARRIER AND DISPENSER

This is a continuation of application Ser. No. 660,410, filed on Oct. 12, 1984, now abandoned.

FIELD OF THE INVENTION

This invention relates to cartridge carriers for firearms; more particularly, it relates to a cartridge carrier of the type adapted to be supported on the body of a person and provided with a dispenser to facilitate loading of a firearm.

BACKGROUND OF THE INVENTION

For long guns and hand guns alike, there has been a longstanding need for an improved cartridge carrier with a cartridge dispenser. The users of such a device, including game hunters, target shooters, police and military personnel, have common needs in respect to the attributes of such a device. Heretofore, the cartridge carriers and dispensers which are available on the market fall in the category of ammunition belts, vests or a belt-mounted device. The belts and vests are characterized as having a plurality of pockets for individual cartridges and thus requiring the user to reach to a different location for each successive cartridge. Belt-mounted devices with a cartridge dispenser are characterized by moving parts and relatively complex mechanisms. Some of such cartridge carriers and dispensers are relatively costly and subject to failure. Further, some are lacking in respect to ease and quickness of use and in respect of personal safety and protection for the cartridges. The firearms art is replete with devices which represent efforts to meet the various needs for a cartridge carrier and dispenser.

The Hudkins U.S. Pat. No. 1,800,731 granted Apr. 14, 1931 discloses an ammunition carrier comprising plural fabric tubes carried by a sling and a belt. Each fabric tube is provided with a metal receptacle at the bottom which has a side opening with integral clamping fingers on opposite sides of the opening. The cartridge falls from the tube into the receptacle and rests on the bottom thereof and is retained against falling out by the clamping fingers. Space is provided to permit the user to grasp the cartridge and pull it through the friction fit of the clamping fingers. The Hudkins carrier uses a plurality of tubes to carry a large number of shells but each tube requires a separate dispensing mechanism. Accordingly, there are several different locations which the user must search to find a cartridge. The fabric tubes can bend and thus prevent the cartridge from dropping into the receptacle. The Hudkins ammunition carrier requires a number of different straps and belts to hold it in place. The clamping fingers of the receptacle are susceptable to catching on heavy underbrush and being permanently bent to an open position and thus allow cartridges to fall out.

The Hammond U.S. Pat. No. 54,147 granted Apr. 24, 1866 discloses a sling-type cartridge carrier with two leather tubes which feed cartridges through a mechanical gate into a dispenser at the bottom. The cartridge is held in the dispenser by an upper pivoted catch pin and a spring loaded sleeve carries the cartridge to a lower catch pin from which it is removed for use. The leather tubes of this cartridge are not rigid and therefore, the tubes collapse and prevent the cartridges from feeding into the dispenser. The dispenser is comprised of movable pins, stops and springs and is subject to fouling due to dirt, sticks, ice formation and the like.

The Walker U.S. Pat. No. 568,220 granted Sept. 22, 1896 discloses a cartridge carrier of the sling-type in which a pair of cloth tubes terminate in respective outlet tubes at the bottom. A stop-head at the open end of each tube prevents the cartridges from falling out. A releasing push bar is operated by the thumb of the user to spread the bottom ends of the tubes apart so that the cartridges can clear the stop-head and the user can grasp and remove one or both cartridges as desired. In this device, the flexible tubes can collapse and prevent the cartridges from feeding into the outlet tubes. Also, the cartridges can hang up on the junction between the cloth tube and the outlet tube. The releasing push bar mechanism is subject to fouling and subject to inadvertent actuation by underbrush and the like. In Walker, the cartridges must be loaded from the bottom and loading would be difficult while the carrier is being worn.

The Feis U.S. Pat. No. 4,381,845 granted May 3, 1983 discloses a belt carried dispenser of rigid construction in which shotgun shells are fed in a sideways position down a vertical tube to a spring loaded push button type dispenser. This dispenser requires the user to wear a belt at the waist level on the outside of the user's coat. The push bar of this device is exposed and could be actuated inadvertently in the underbrush. The feed mechanism is subject to malfunction in that the sideways feed of the cartridges and the clear space in the housing permits them to bounce around and lodge in a canted or upright position.

A general object of this invention is to provide an improved cartridge carrier with a dispenser which overcomes certain disadvantages of the prior art.

SUMMARY OF THE INVENTION

This invention provides a cartridge carrier with a dispenser which affords a high degree of safety for the user and a high degree of protection for the cartridges and yet is extremely simple and reliable in use. It accomodates a large number of cartridges and is highly adaptable to comfortable and trouble-free support on the body for either a right-hand or left-hand shooter. Further, the carrier and dispenser are implemented with an extremely simple mechanism with a minimum of moving parts. The device is fabricated of light weight and low cost materials and lends itself to low manufacturing costs.

In accordance with the invention, a rigid tube with a unitary dispenser is adapted to receive plural cartridges through a loading mouth in end-to-end relation and is supported by a sling in an attitude for providing gravity feed of the cartridges. A cartridge dispenser slot is provided in the wall of the tube above a bottom stop means. A deflecting means is provided for deflecting the bottom cartridge so that the shot-end thereof extends obliquely through the dispenser slot and retaining means yieldingly holds the rim-end of the bottom cartridge within the tube. The shot-end of the bottom cartridge may be grasped by the person's hand to remove it through the dispenser slot. Preferably, the tube is constructed of a polymeric material, such as a commercial low density polyethylene tubing which is commonly used as a fluid conduit. The tube is of circular cross-section which provides a loose fit for the cartridges and is preferably arcuate between its upper and lower ends with a sufficient radius of curvature so that the cartridges slide freely without binding. The arcuate shape provides a comfortable fit on the user's body and yet permits free gravity feed of the cartridges. Preferably, the deflecting means comprises a finger opening in the wall of the tube opposite the dispenser slot. The finger opening comprises an aperture in the wall with a deflectable tongue unitary with the wall and being engageable with the shot-end of a cartridge to deflect it outwardly through the dispenser slot. The retaining means preferably comprises convergent side edges bounding the dispenser opening with the edges having a minimum spacing from each other less than the diameter of a cartridge, the edges being sufficiently yieldable so that a cartridge can be pushed therebetween by finger pressure of the user. Further, the retaining means is provided with a tab unitary with the tube and being adapted to catch the rim of the cartridge when the shot-end is pushed outwardly while the side edges of the dispenser slot resiliently grip the cartridge to retain it in an oblique attitude. Further, the tube is provided with a one-way gate means near the upper end for passing cartridges in the top-to-bottom direction. The gate means comprises a pawl unitary with the tube which prevents cartridges from being spilled out the top when the carrier is inverted. Further, the bottom stop means preferably comprises a pin extending through the tube. The sling is connected at one end to the stop pin by a swivel connector and at the other end to the upper end of the tube.

A more complete understanding of this invention may be obtained from the detailed description that follows taken with the accompanying drawings.

DESCRIPTION OF THE DRAWINGS

FIG. 1 shows the cartridge carrier and dispenser of this invention in its operative position on the body of a user;

FIG. 2 shows an elevation view of the carrier and dispenser;

FIG. 3 shows a view of the lower end;

FIG. 4 illustrates a preliminary stage of operation of the dispenser;

FIG. 5 illustrates an intermediate stage of operation of the dispenser; and

FIG. 6 shows a view of the upper end with the carrier and dispenser inverted.

BEST MODE FOR CARRYING OUT THE INVENTION

Referring now to the drawings, there is shown an illustrative embodiment of the invention in a cartridge carrier and dispenser comprising a tubular plastic body of unitary construction with a shoulder sling attached thereto and adapted especially for shotgun cartridges. It will be appreciated as the description proceeds that the invention may be embodied in different forms and adapted for different firearm cartridge applications.

The cartridge carrier and dispenser 10 of this invention is shown in FIG. 1 as it is carried by a typical right-handed shotgun shooter. In general, it comprises a tube 12 and a sling 14. The sling 14 extends over the user's left shoulder and the tube 12 is carried by the sling under the user's right arm.

The tube 12 is constructed of polymeric material and is of circular cross-section and of uniform wall thickness throughout its length. Preferably, the tube 12 is a piece of conventional plastic pipe or tubing of the type used for water and other fluid systems; in the illustrative embodiment it is low density polyethylene tubing (LDPE), although other materials such as polyvinyl chloride (PVC) tubing can be used. The tubing is available in various diameters and is usually supplied in lengths many feet long and rolled into a coil for storage and handling purposes. Such tubing is a preferred material for the tube 12 because it has a normal curvature due to the memory or set of the material which results from the extrusion and forming of the pipe into a coil.

In the illustrative embodiment, the tube 12 is adapted for twelve gauge shotgun shells or cartridges. For this purpose, the tube 12 is a piece of curved LDPE tubing having a one inch inside diameter and a wall thickness of approximately one-eighth inch. The length of the curved tube 12 from tip-to-tip is approximately twenty-six inches. It has a radius of curvature approximately equal to twenty times the length of each cartridge. Such an arcuate configuration of the tube 12 is very desirable so that the tube can hang in natural conformity with the body of the person wearing the device and yet the radius of curvature is large enough so that the cartridges can move freely through the tube. The radius of curvature should not be less than about ten times the length of a cartridge in order to prevent possible binding of a cartridge as it moves through the tube.

The tube 12 terminates at its upper end in a beveled input opening or loading mouth 16 adapted to receive cartridges in an end-feed fashion for loading the tube. The tube 12 is provided at its lower end with stop means in the form of a headed stop pin 18 extending diametrically through the tube to prevent cartridges from passing therethrough.

The tube 12 is provided at its lower end above the headed stop pin 18 with a cartridge dispenser slot 22 for allowing removal of one cartridge at a time from the tube by the user. A cartridge deflecting means in the form of a finger opening 24 is provided diametrically opposite the dispenser slot 22 to allow the user to initiate ejection of a cartridge through the dispenser opening. A one-way gate in the form of a pawl 26 is provided at the upper end of the tube 12 on the concave side thereof to allow loading of the tube but to prevent cartridges from falling out if the tube is inverted. The construction and operation of the cartridge dispenser slot 22, the finger opening 24 and the pawl 26 will be described in detail subsequently.

The sling 14 comprises an adjustable strap 28 which is secured to the tube 12 at the upper end by a pivot ring 32 and at the lower end by a swivel ring 34. The strap 28 is preferably a polypropylene webbing having a loop at the upper end extending through the ring 32 and secured by an adjustable slide buckle 36. The ring 32 is formed of stiff wire and the two free ends thereof extend through a hole in the wall of the tube 12 and are bent over to secure the attachment. The lower end of the strap 14 is attached to the swivel ring 34 by a sewn loop. The swivel ring 34 is constructed of stiff spring wire and is formed with a bight which snaps into an annular groove in the head of the stop pin 18.

The tube 12 is adapted to serve as a rigid conduit for the cartridges carried therein and to maintain its circular cross-section throughout all normal operating conditions so that the cartridges are freely slidable under the influence of gravity. The tube 12 should have a stiffness, by reason of the properties of the material and the relationship of wall thickness and diameter, such that the loading to be imposed upon the tube will not bend and cause the cartridges to bind or cause the wall of the tube to collapse. As a minimum, the tube should have sufficient stiffness to resist the bending moments without collapse which result from support of the tube by only the sling when the tube is filled with cartridges and held in a horizontal position.

The cartridge dispenser slot 22 is adapted for removal of one cartridge at a time by the user. As will be described below, the removal process comprises the deflection of the lowermost cartridge from central alignment with the tube 12 to a cocked or oblique attitude, with the shot-end of the cartridge extending through the dispenser slot 22 and the rim-end of the cartridge retained inside the tube. For this purpose, the dispenser slot 22 is located in the outboard side of the tube, i.e. the side remote from the user's body. The dispenser slot 22 has the general shape of a key hole. More specifically, the slot 22 is bounded by side edges 38 and 38' which are convergent from both ends toward the mid-section thereof such that the spacing therebetween at the mid-section is less than the diameter of the cartridge. The bounding edges of the slot at the upper and lower ends thereof are spaced apart by a distance about equal to or slightly larger than the diameter of the cartridge. The upper end of the slot 22 is bounded by an M-shaped edge forming a tab 42 which extends downwardly so that its lower end is disposed opposite the upper portion of the rim-end of the cartridge. The convergent side edges 38 and 38' and the tab 42 constitute a retaining means for preventing the bottom cartridge from falling out of the tube; the side edges, with or without the tab, hold the cartridge in a cocked or oblique attitude when it is deflected. For this purpose, the side edges 38 and 38' are sufficiently yieldable so that the cartridge can be pushed laterally therebetween to the oblique attitude with the cartridge being resiliently gripped by the side edges while the tab 42 prevents lateral movement of the rim-end of the cartridge and may catch the rim when the cartridge is deflected. The operation of dispensing a cartridge from the tube 12 will be described in more detail subsequently.

The cartridge deflecting means comprising the finger opening 24 is adapted for deflection of the bottom cartridge to the oblique attitude in the dispenser slot 22. For this purpose, the finger opening 24 is located in the inboard side of the tube 12 diametrically opposite the dispenser slot 22. The finger opening 24 is bounded by side edges 44 and 44' which are generally parallel to each other extending axially of the tube and by a bottom edge 46 which extends transversely of the tube. The lower portion of the opening 24 is laterally enlarged to accomodate the user's finger, as will be described presently. The finger opening 24 also comprises a deflectable tongue 48 which is substantially rectangular and depends from a hinge 52 which is unitary with the wall of the tube 12 at the top of the opening and extends substantially to the bottom thereof. The length of the deflectable tongue 48 is approximately the same as the length of the cartridge. The tongue 48 is adapted to be deflected inwardly of the tube 12 by the user's finger to push the shot-end of the bottom cartridge into its oblique attitude.

For the purpose of preventing the cartridges within the tube 12 from being spilled out the upper end in case the tube is inverted, the one-way gate comprising the pawl 26 is provided at the upper end of the tube. The pawl 26 is wedge-shaped and formed by slitting the tube to provide side edges 54 and 54' terminating in a free end 56. The upper end is unitary with the wall of the tube and constitutes a hinge 58 for the pawl. As shown most clearly in FIG. 6, the pawl 26 has a rest position in which the free end 56 is disposed inwardly of the wall of the tube 12. This rest position results from the normal curvature of the tube 12, as discussed above; when the pawl 26 is formed by slitting the tube the residual stresses in the tube wall cause the free end to move inwardly. Thus, the pawl 26 is readily deflected outwardly to allow passage of a cartridge in the top-to-bottom direction but it springs back to its rest position once the cartridge is passed. In its rest position it blocks the passage of a cartridge in the bottom-to-top direction, for example, when the tube is inverted as shown in FIG. 6.

In use of the cartridge carrier and dispenser of this invention, the tube 12 is filled with cartridges by hand feeding them end-to-end as indicated in FIG. 2 through the loading mouth 16. This can be accomplished with the carrier and dispenser supported on the body, if desired, by suitably positioning the sling 14 for that purpose. With the tube 12 loaded with cartridges, and the carrier and dispenser 10 positioned as shown in FIG. 1, the cartridges are gravity fed so that the bottom-most cartridge rests against the stop pin 18, as shown in FIG. 2. If the tube 12 happens to become inverted, as shown in FIG. 6, the pawl 26 catches the cartridges adjacent the loading mouth 16 and prevents the cartridges from spilling out of the tube. When the user desires to dispense a cartridge for loading his gun, he grasps the lower end of the tube 12, as shown in FIG. 4, and presses the deflectable tongue 48 inwardly, as shown in FIG. 5, against the shot-end of the cartridge to deflect it outwardly of the tube 12. This causes the central section of the cartridge to move between the side edges 38 and 38' of the dispenser slot while the rim-end of the cartridge is held within the tube by the tab 42. The side edges 38 and 38' yieldingly separate to permit the cartridge to pass therebetween. When the finger pressure on the tongue 48 is released the cartridge is held in the oblique position, as shown in FIG. 5, by the gripping action of the side edges 38 and 38' of the dispenser slot. This holding action may be assisted by the tab 42. The user can tell by feel when the cartridge has been deflected sufficiently against the resistance of the side edges 38 and 38' of the dispenser slot. The cartridge will be held in position when the side edges engage diametral points on the cartridge or when the points of engagement are on either side thereof. With the cartridge held in the oblique position, the user may use the same hand to grasp the shot-end of the cartridge and pull it through the dispenser slot 22 for loading his gun. As the cartridge is pulled from the dispenser slot another cartridge slides down the tube to take its place.

Although the description of this invention has been given with reference to a particular embodiment, it is not to be construed in a limiting sense. Many variations and modifications will now occur to those skilled in the art. For a definition of the invention reference is made in the appended claims.

What is claimed is:

1. A firearm cartridge carrier for cartridges of the type having a generally cylindrical body and two ends, said carrier comprising:

a tube terminating in a loading end and a dispenser end and adapted to receive a plurality of cartridges therebetween in end-to-end relation, support means on said tube for supporting said tube on the body of a person with the loading end higher than the dispenser end for providing gravity feed of said cartridges, said tube having a cartridge stop means at the dispenser end and a cartridge input opening at the loading end, a cartridge dispenser opening in the wall of said tube above said stop means, manually actuable deflecting means comprising a finger opening in the wall of said tube opposite said dispenser opening for deflecting one end of the bottom cartridge so that said one end extends laterally through said dispenser opening and obliquely of said tube, and retaining means for yieldingly holding the other end of said bottom cartridge within the tube when said one end is deflected by said manually actuable deflecting means, whereby said one end of said bottom cartridge may be grasped by said person's hand to remove said bottom cartridge through said dispenser opening.

2. The invention as defined in claim 1 wherein said tube is constructed of polymeric material and is circular in cross-section with uniform wall thickness.

3. The invention as defined in claim 1 wherein said tube is arcuate between said loading and dispenser ends.

4. The invention as defined in claim 1 wherein said finger opening comprises an aperture in said tube wall and a deflectable tongue unitary with said wall extending into said aperture and being adapted to be deflected against the bottom of a cartridge by the finger of said person.

5. The invention as defined in claim 1 wherein said retaining means comprises convergent side edges bounding said dispenser opening, said edges having a minimum spacing from each other which is less than the diameter of said cartridge, said edges being sufficiently resilient so that a cartridge can be pushed therebetween by finger pressure from said person.

6. The invention as defined in claim 1 wherein said retaining means comprises convergent side edges bounding said dispenser opening and a tab unitary with said tube and extending into the top of said dispenser opening, said tab being disposed opposite a portion of the upper edge of said cartridge and adapted to catch the rim of said cartridge when the lower end of said cartridge is pushed outwardly of said tube through said dispenser opening, the side edges of said dispenser opening being spaced from each other so as to resiliently grip said cartridge when it is pushed through said dispenser opening whereby said cartridge is retained in an oblique attitude by said tab and said side edges with the lower end thereof outside the tube and the upper end thereof inside the tube.

7. The invention as defined in claim 1 including a unidirectional gate means disposed near the loading end of said tube for passing cartridges in the upper to lower direction but preventing passages of cartridges in the lower to upper direction.

8. The invention as defined in claim 7 wherein said unidirectional gate means comprises a pawl unitary with said tube and having its lower end positioned inside the adjacent wall of said tube.

9. The invention as defined in claim 2 wherein said stop means comprises a pin extending through said tube and wherein said sling is attached at the lower end by a swivel to connect it to said pin.

10. The invention as defined in claim 1 wherein said tube is constructed of a unitary body of polymeric material.

11. The invention as defined in claim 1 wherein said support means comprises:

a sling attached at two spaced locations to said tube, said tube having sufficient stiffness to resist, without collapse thereof, the bending moments resulting from forces applied thereto by said support means when filled with said cartridges and held by said sling in a horizontal position.

* * * * *